US006233311B1

(12) United States Patent
Itoh et al.

(10) Patent No.: US 6,233,311 B1
(45) Date of Patent: May 15, 2001

(54) ROTARY ANODE FOR X-RAY TUBE COMPRISING AN MO-CONTAINING LAYER AND A W-CONTAINING LAYER LAMINATED TO EACH OTHER AND METHOD OF PRODUCING THE SAME

(75) Inventors: Masayuki Itoh, Yamagata; Koji Asahi, Toyama; Mitsuo Osada; Yoshinari Amano, both of Yamagata; Tomohiro Takida, Toyama, all of (JP)

(73) Assignee: Tokyo Tungsters Co., Ltd., Tokyo (JP)

( * ) Notice: Subject to any disclaimer, the term of this patent is extended or adjusted under 35 U.S.C. 154(b) by 0 days.

(21) Appl. No.: 09/258,077

(22) Filed: Feb. 26, 1999

(30) Foreign Application Priority Data

Feb. 27, 1998 (JP) ..... 10-047711
Jan. 12, 1999 (JP) ..... 11-004887

(51) Int. Cl.[7] ..... H01J 35/10
(52) U.S. Cl. ..... 378/144; 378/143; 378/125
(58) Field of Search ..... 378/144, 143, 378/125

(56) References Cited

U.S. PATENT DOCUMENTS 4,461,020 * 7/1984 Hubner et al. ..... 378/144

FOREIGN PATENT DOCUMENTS 0 359 865 3/1990 (EP) .
1 121 407 7/1968 (GB) .

OTHER PUBLICATIONS

Kasten, Roy F., "Balancing", Dunlee Digest, vol. 14, #2, Apr./May/Jun. 1969, pp. 1–2.*
Patent Abstracts of Japan, vol. 017, No. 608, Nov. 9, 1993 (corresponds to JPA 5–190127, published Jul. 30, 1993 with Abstract).
Patent Abstracts of Japan, vol. 013, No. 350, Aug. 7, 1989 (corresponds to JPA 1–109647, published Apr. 26, 1989 with Abstract).

* cited by examiner

*Primary Examiner*—Robert H. Kim
*Assistant Examiner*—Drew A. Dunn
(74) *Attorney, Agent, or Firm*—Sughrue, Mion, Zinn, Macpeak & Seas, PLLC

(57) ABSTRACT

Provided are a high-quality and high-reliability rotary anode target for X-ray tubes, of which the mechanical strength at high temperatures is increased and which is applicable not only to low-speed rotation (at least 3,000 rpm) but also even to high-speed rotation at high temperatures, and also a method for producing it. The rotary anode has a two-layered structure to be formed by laminating an Mo alloy substrate that comprises from 0.2% by weight to 1.5% by weight of TiC with the balance of substantially Mo, and an X-ray generating layer of a W—Re alloy that overlies the substrate.

4 Claims, 6 Drawing Sheets

ROTARY ANODE FOR X-RAY TUBE COMPRISING AN MO-CONTAINING LAYER AND A W-CONTAINING LAYER LAMINATED TO EACH OTHER AND METHOD OF PRODUCING THE SAME

BACKGROUND OF THE INVENTION (1) Field of the Invention

The present invention relates to a rotary anode for X-ray tubes, and to a method for producing it.

(2) Description of the Related Art

As the rotary anode, hereinafter referred to as target, for X-ray tubes, heretofore use is made of a two-layered structure composed of an X-ray generating layer of a high-melting-point metal of pure tungsten (hereinafter referred to as pure W) or a rhenium-tungsten (hereinafter referred to as Re—W) alloy and an underlying substrate of pure molybdenum (hereinafter referred to as pure Mo) or TZM (this indicates an alloy of 0.5% Ti—0.07% Zr—0.05% C-balance of Mo) as laminated together.

For producing the conventional target, pure W powder or a mixed powder of Re powder and W powder, which is previously mixed with an organic binder to form a material powder. The material powder is put into a mold, and lightly compressed therein from the upper and lower sides. Thereafter, the material powder is stacked with an additional material powder which consists of a predetermined amount of Mo powder or a mixed powder to give a composition of TZM. The additional material powder is previously mixed with an organic substance and, thereafter, put into the mold to form a stacked material body. The stacked material body is compressed therein from the upper and lower sides to give a two-layered disc molding.

Next, the organic substance is removed from it in a hydrogen atmosphere at a temperature falling between 300 and 500° C. Thereafter, the molding is sintered in hydrogen at 1800° C. to form a sintered body. The density of the sintered body generally falls between 90 and 95%.

For increasing its density and for making it have an umbrella-like shape, the sintered body is then subjected to plastic working of, for example, hot rolling and/or hot forging to thereby make it have an umbrella-like shape nearly approaching its final shape, and thereafter this is machined to have a final target shape. In the last step, the thus-shaped target is degassed in vacuum at a temperature of around 1500° C. for the purpose of removing the gaseous component from it. After those steps, the intended target is produced.

However, targets are used under severe conditions, for example, at high temperatures and at high rotating speeds, e.g., at 10,000 rpm. Therefore, the targets are desired to be high quality. In particular, as they shall generate X rays in high vacuum, their life is greatly shortened if the vacuum degree around them is lowered. In addition, if the organic binder used could not be completely removed from them during their production, it remains in them as a carbon residue. In that condition, the targets themselves are heated at high temperatures owing to thermions dashing thereon, and will be dead in a lowered vacuum degree.

Moreover, the conventional process requires long and complicated steps, and also requires expensive raw materials of W, Re and Mo in a large amount of from 3.0 to 4.0 times the weight of the final products. The process thus requiring such a large amount of natural resources and even much energy could not be one that is gentle to the environment.

Furthermore, the process could not meet the current requirements, as being uneconomical and expensive.

SUMMARY OF THE INVENTION

It is an object of the present invention to provide a method for producing a high-quality and high-reliability rotary anode for X-ray tubes, which does not require any vapor-generating component in its production steps.

It is another object of this invention to provide a rotary anode for X-ray tubes, which is inexpensive and gentle to the environment.

It is still another object of this invention to provide a method for producing the rotary anode for X-ray tubes.

Before completion of this invention, we, the present inventors have developed a method for producing a rotary anode target, hereinafter referred to as a simple term of "target", for X-ray tubes, in which the grain size of the Re—W layer and that of the Mo powder for the target are optimized, the contraction of the target being sintered after isostatic powder molding is unified, and the carbon residue in the target is reduced through isostatic molding not requiring any organic substance, and have found an economical method for producing a high-quality and long-life target that is well applicable to high-speed rotation use in high-temperature and high-vacuum conditions. The method requires reduced amounts of raw materials and shortened and simplified steps. On the basis of these findings, we have completed the present invention.

According to one aspect of the present invention, there is provided a rotary anode for X-ray tubes having a two-layered structure composed of a Mo-containing layer and a W—Re alloy layer laminated to the Mo-containing layer. The Mo-containing layer consists essentially of Mo or an Mo alloy.

In this aspect of the present invention, preferably, the Mo-containing layer is a substrate, and the W—Re alloy layer is an X-ray generating layer that overlies the substrate. Also preferably, the Mo-containing layer is comprised of at least one of TiC, HfC and ZrC in an amount of from 0.2% by weight to 1.5% by weight, and the balance of substantially Mo.

In this aspect of the present invention, still preferably, the substrate has a bending strength at 700° C. of 800 MPa or more, and has a tensile strength at 1000° C. of 300 MPa or more.

According to another aspect of the present invention, there is provided a method of producing a rotary anode for X-ray tubes. The rotary anode has a two-layered structure composed of a Mo-containing layer and a W—Re alloy layer laminated to said Mo-containing layer. The Mo-containing layer consists essentially of Mo or an Mo alloy.

In the aspect of the present invention, the method comprises a step of filling a W-containing powder and a Mo-containing powder into a mold to give a two-layered structure, the W-containing powder consisting essentially of W powder and Re powder, the Mo-containing powder consisting essentially of Mo powder or Mo powder and at least one of TiC powder, HfC powder and ZrC powder, followed by isostatically molding it to prepare a compacted body nearly approaching its final shape, a first sintering step of sintering the compacted body in a hydrogen atmosphere into a first sintered body, a second sintering step of further sintering the first sintered body in vacuum into a second sintered body, and a machining step of machining the second sintered body into the intended rotary anode.

In the aspect of the present invention, the method comprises a step of filling a W-containing powder that comprises W powder and Re powder, and an Mo-containing powder that comprises Mo powder, or comprises Mo powder and at least one of TiC powder, HfC powder and ZrC powder, into a mold to give a two-layered structure, followed by isostatically molding it to prepare a compacted body nearly approaching its final shape, a first sintering step of sintering the compacted body in a hydrogen atmosphere into a first sintered body, a second sintering step of further sintering the first sintered body in vacuum into a second sintered body, and a machining step of machining the second sintered body into the intended rotary anode.

In this aspect of the present invention, it is preferable that the starting materials of W powder, Re powder and Mo powder have a mean grain size falling between 1 and 5 $\mu$m.

In the invention, TiC is thermally stable and enhances the intergranular strength of Mo, thereby improving the strength of the Mo-containing structure at room temperature and even at high temperatures. In addition, even when the TiC-containing material is exposed to high temperatures, the grains constituting it are prevented from growing into coarse and large grains. For these reasons, therefore, it is preferable that the Mo-containing layer and its material of Mo-containing powder contain TiC.

However, when the TiC content of the Mo-containing powder is smaller than 0.2% by weight, the effect of TiC therein to enhance the intergranular strength of Mo will be poor, and, in addition, TiC could hardly prevent the grains from growing into coarse and large ones at high temperatures. The Mo-containing powder having such a small TiC content will be substantially the same as pure Mo. On the other hand, when the TiC content of the Mo-containing powder is larger than 1.5% by weight, the relative density of Mo in the substrate will be low, thereby often resulting in that the substrate is cracked especially during plastic working to lower the yield of the product.

For these reasons, therefore, it is desirable that the Mo-containing powder is prepared by adding TiC powder to Mo powder in an amount of from 0.2% by weight to 1.5% by weight.

In the invention, also preferably, the Mo alloy substrate layer and the X-ray generating layer of a W—Re alloy are formed according to a process that comprises press-molding the raw materials for the two layers through powdery metallurgy into a two-layered green compact, then subjecting the green compact into first sintering in a reducing atmosphere of, for example, hydrogen or the like at a temperature falling between 1500 and 2100° C. continuously followed by second sintering in an inert atmosphere or in vacuum at a temperature higher than the first sintering temperature, and thereafter degassing the thus-sintered body at a temperature lower than the second sintering temperature.

In the invention, it is further preferable that the sintering step in the second sintering step falls between 1800 and 2200° C. and that the vacuum degree in the vacuum sintering falls between $10^{-6}$ Torr and $10^{-8}$ Torr.

DESCRIPTION OF THE PREFERRED EMBODIMENTS

Figure 1:
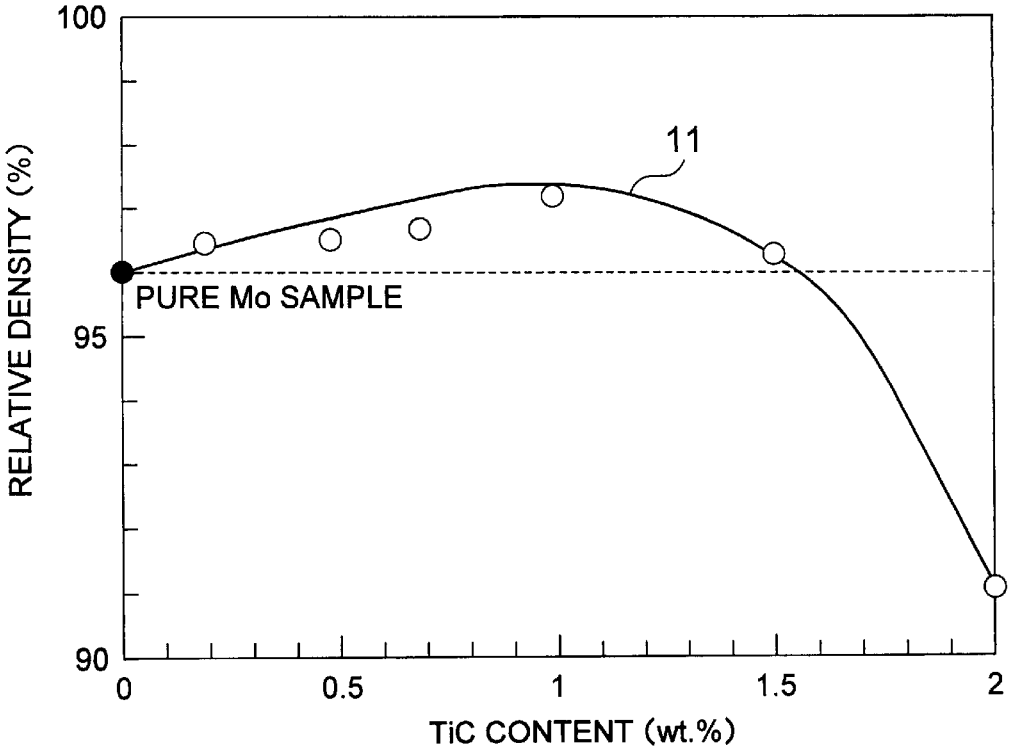
FIG. 1 is a graph showing the relationship between the TiC content and the relative density of TiC-added samples of the invention and a comparative, pure Mo sample, all prepared in the first embodiment of the invention through vacuum sintering at 2000° C.

Embodiments of the invention are described below.

The rotary anode (hereinafter referred to as a simple term of "target") for X-ray tubes of the invention has a two-layered structure to be prepared by laminating an Mo-containing substrate layer of an Mo material or an Mo alloy material comprising, by weight, 0.2 to 1.5% of at least one of TiC powder, HfC powder and ZrC powder, with the balance of substantially Mo, and an X-ray generating layer of a W—Re alloy. In the target, the substrate has a bending strength of 800 MPa or more at 700° C., and has a tensile strength of 300 MPa or more at 1000° C. In this, the X-ray generating layer consists substantially of an Re—W alloy.

In particular, the target of the invention has a two-layered structure composed of an Mo alloy substrate layer and an X-ray generating layer. The Mo alloy is formed by adding 0.2 to 1.5%, by weight, of TiC powder to Mo powder. The X-ray generating layer comprises W or a W alloy.

Conventional targets were produced through plastic working for thickness reduction, in terms of the degree of plastic working, of at least 20% for improving the mechanical strength of the substrate therein.

In this invention, however, TiC-added Mo alloys substitutable for Mo, TZM and others have been developed as the material for the substrate for targets. Based on this, the invention has realized the production of targets in which the substrate of such a TiC-added Mo alloy has a higher mechanical strength at high temperatures than that of Mo or TZM in the conventional targets, even when the sintered bodies for the targets are subjected to plastic working for lower thickness reduction, in terms of the degree of plastic working, of at most 20% and even smaller than 20%, or not subjected to plastic working at all.

Therefore, for the targets from sintered bodies having been subjected to plastic working for such lower thickness reduction or not having been subjected to plastic working at all, such as those in the invention, the plastic working time is shortened. In addition, in those, the cracking failure owing to working strain is reduced, and the product yield is increased. As a result, the production costs for the targets are reduced.

As above-mentioned, in the target of the invention having such a high mechanical strength, TiC could enhance the intergranular strength of the substrate while preventing the grains in the substrate from growing into coarse and large grains, even when the target is heated at high temperatures while it is produced or after it is built in an X-ray tube. Therefore, the grains constituting the substrate of the target of the invention hardly grow into coarse and large grains and hardly embrittle. As a result, the target is applicable to high-speed rotation at high temperatures. Specifically, the invention has realized the production of such high-quality, high-reliability, low-priced targets applicable not only to low-speed rotation but also even to high-speed rotation at high temperatures.

For increasing the capacity of targets, it is said necessary to enlarge their size and to reduce their weight. For this, graphite is generally used as the substrate for targets. According to the invention, an Mo alloy is prepared which contains TiC, in place of pure Mo or a TZM alloy, for the substrate for targets, and an X-ray generating layer of a W—Re alloy is laminated onto the substrate layer to produce a two-layered target. In this connection, it is obvious that even a three-layered target of W—Re alloy/Mo/graphite also has high bending strength and high tensile strength and is therefore applicable to high-speed rotation at high temperatures.

The target of the invention is described more concretely hereinunder with reference to some examples of it.

EXAMPLE 1

To investigate the properties of the substrate for targets, samples were prepared and tested according to the process mentioned below.

Mo powder having a mean grain size of 4.0 $\mu$m, was added with, by weight, 0.2 to 2.0% of TiC powder having a mean grain size of 1.0 $\mu$m, dry-blended in a V-type mixer, then molded in a mold under a pressure of 294 MPa, and sintered in vacuum at 2000° C. to prepare samples, which will be hereinafter referred to as TiC-added samples. Apart from those, a comparative sample of pure Mo was prepared in the similar manner being above-described, to which no TiC powder was added.

Test pieces were cut out of the TiC-added samples and the pure Mo sample to have a size of 3×8×25 mm. The density of each piece was measured according to a submerged density method, from which was obtained the relative density of each sample.

Figure 2:
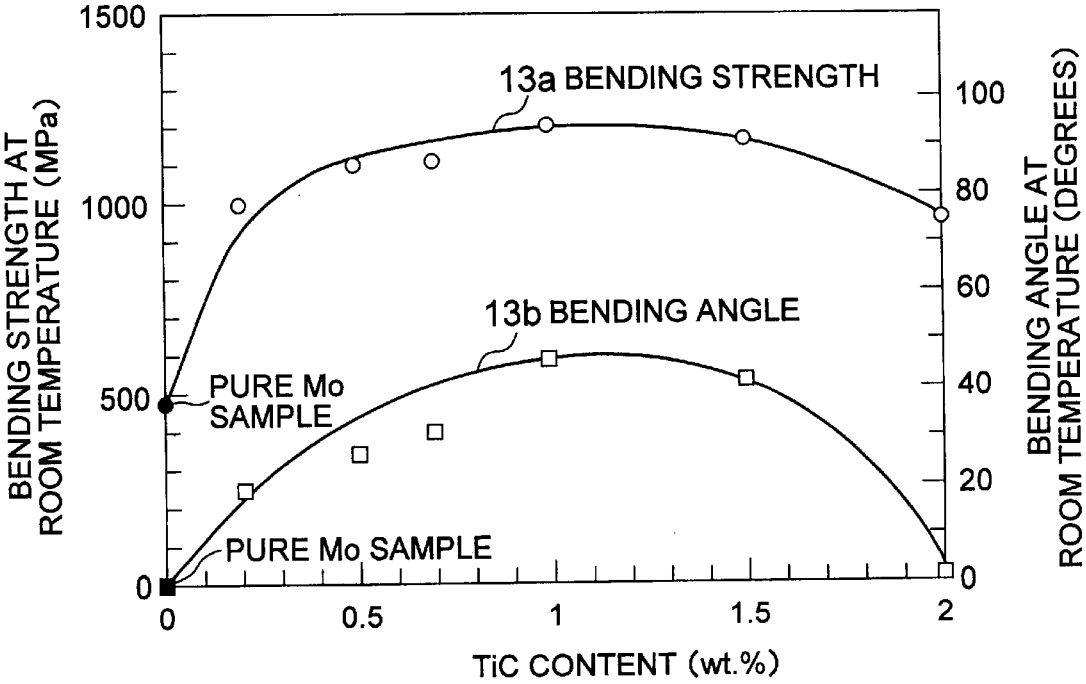
FIG. 2 is a graph showing the bending test data at room temperature of the TiC-added samples of the invention and the comparative, pure Mo sample prepared in the first embodiment, in which are shown the bending strength and the bending angle at room temperature of the samples relative to the TiC content thereof.

After its density was measured, each test piece was subjected to a three-point bending test to measure its bending strength and bending angle. The tree-point test was carried out on the condition that the gauge length was 20 mm, that the cross head speed was 1 mm/min, and that the temperature for the test was room temperature and 700° C. The bending strength and the bending angle, both of which are shown in FIG. 2 to be mentioned hereinunder, were calculated from the maximum load and displacement in the load-displacement curve. Owing to the structure of the test device used, the bending angle could not be larger than 100 degrees. Therefore, the bending angle of 100 degrees was referred to as "full-bend".

The sintered samples were heated at 2000° C. and 2200° C., and their grain sizes were measured through texture observation. The mean grain size as referred to herein was obtained according to an area metering method.

FIG. 1 shows the relationship between the TiC content and the relative density of the TiC-added samples of the invention of Example 1 (the curve 11 for ○), together with that of the comparative, pure Mo sample (●). The relative density was calculated according to the following equation, relative density (%)=measured density/theoretical density. The curve 11 in FIG. 1 indicates that the increase in the TiC content up to 1.0% by weight brings about gradual increase in the relative density, but when the TiC content is larger than 1.0% by weight, the relative density greatly lowers with its increase.

The relative density of the TiC-added samples of the invention of Example 1 is larger than that of the comparative, pure Mo sample. However, the relative density of the 2.0 wt. % TiC-added sample is small, or is about 91%.

FIG. 2 shows the three-point bending test data at room temperature of the TiC-added samples of the invention and the comparative, pure Mo sample of Example 1. As shown, the samples having a larger TiC content of up to 1.0% by weight have a higher bending strength (the curve 13*a* for ○) and a higher bending angle (the curve 13*b* for □).

On the other hand, when the TiC content of the samples is larger than 1.0% by weight, both the bending strength and the bending angle thereof lower with its increase.

In addition, in Example 1, the bending strength of the TiC-added samples (○ in FIG. 2) of the invention, is higher by from 500 to 600 MPa than that of the comparative, pure Mo sample (● in FIG. 2). The pure Mo sample has no ductility (■ in FIG. 2, having a bending angle of 0 degree). Adding TiC to the pure Mo sample resulted in the increase in the ductility of the TiC-added samples (□ in FIG. 2), which had a bending angle falling between 20 and 50 degrees. However, the 2.0 wt. % TiC-added sample had little ductility, having a bending angle of a few degrees.

Figure 3:
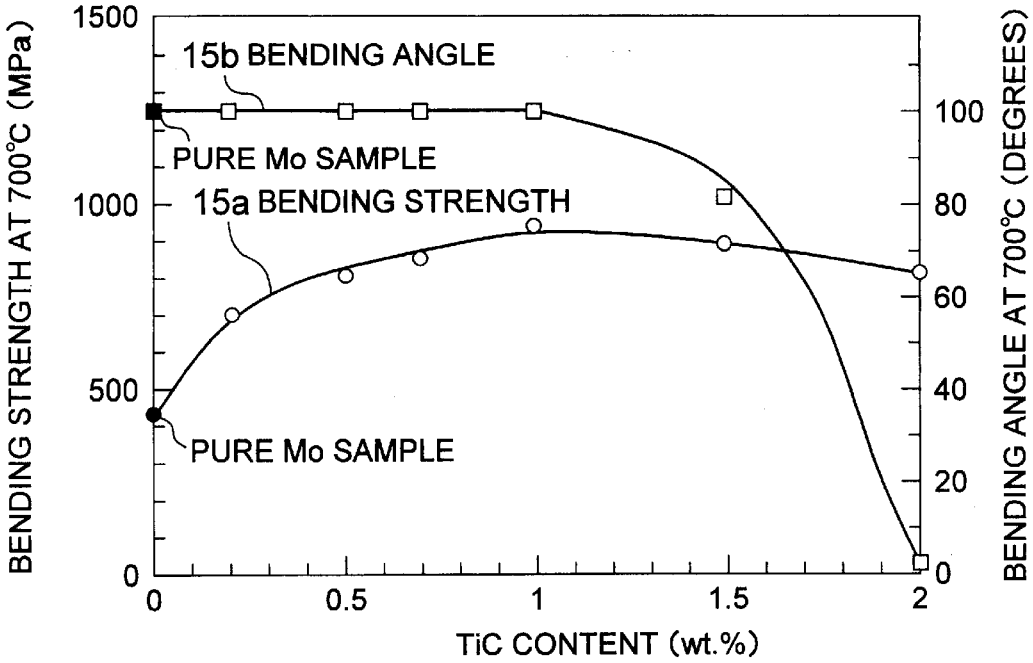
FIG. 3 is a graph showing the bending test data at 700° C. of the TiC-added samples of the invention and the comparative, pure Mo sample prepared in the first embodiment, in which are shown the bending strength and the bending angle at 700° C. of the samples relative to the TiC content thereof.

FIG. 3 is referred to, in which the curve 15*a* for ○ indicates that the bending strength of the TiC-added samples having a TiC content of smaller than 0.2% by weight is larger in some degree than that of the pure Mo sample (●), but the TiC addition did not bring about any significant effect. Up to 1.0% by weight, the TiC-added samples having a larger TiC content have a higher bending strength, but over 1.0% by weight, their bending strength gradually lowers.

As shown in FIG. 3, the curve 15*b* for □ indicates that the bending angle of the TiC-added samples having a TiC content of up to 1.0% by weight is for the "full-bend", or that is, these samples have good ductility, but the 2.0 wt. % TiC-added sample has little ductility, having a bending angle of a few degrees.

Figure 4:
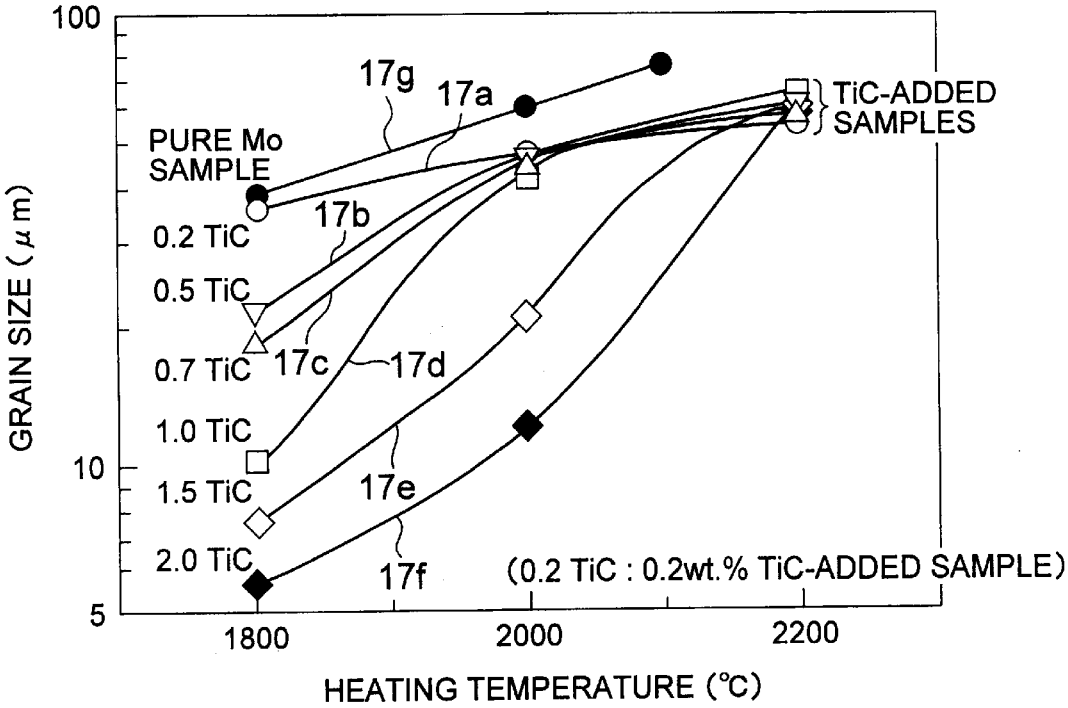
FIG. 4 is a graph showing the temperature dependence of the grain size of the TiC-containing samples of the invention and the comparative, pure Mo sample prepared in the first embodiment.

FIG. 4 is referred to, in which the curves 17*a* to 17*f* indicate that the TiC-added samples of the invention of Example 1 have a smaller grain size than the pure Mo sample as indicated therein by the curve 17*g* for ●, after having been sintered at 1800° C.

As shown in FIG. 4, the increase in the TiC content of the samples resulted in the reduction in the grain size thereof.

When heated at higher temperatures, the samples have a larger grain size, but the grains of the TiC-added samples are prevented from growing into coarse and large ones, as compared with those of the pure Mo sample.

Based on the data of FIG. 1 to FIG. 4 noted above, the amount of TiC to be added to the Mo-containing substrate layer is defined to fall between 0.2% by weight and 1.5% by weight. Next, the targets samples were actually made by the uses of the 1.0 wt. % TiC-added sample which had been evaluated totally good and the target samples produced were evaluated as follows.

EXAMPLE 2

W powder having a mean grain size of 2.6 μm was added with 5.0%, by weight, of Re powder having a mean grain size of 3.0 μm, and dry-blended in a V-type mixer to prepare W-5.0 wt. % Re powder. This was used herein as the material for an X-ray generating layer. As the material for the underlying substrate layer, use was made of Mo-1.0 wt. % TiC powder that had been prepared in the similar manner being described in Example 1. The two materials were molded in a mold into a two-layered body, which was then sintered in hydrogen at 1800° C., and then further sintered in vacuum at 2000° C. to thereby increase the relative density of the W-5.0 wt. % Re layer. The resulting sintered body was machined to have a predetermined shape, and then degassed in vacuum at 1500° C. Thus a target was produced in which the X-ray generating layer was of W—Re and the substrate layer was of the TiC-added Mo material, this is hereinafter referred to as a TiC-added sample.

Apart from this, as each of comparative samples, a hot-forged target was produced in which the substrate layer was of pure Mo and which had been hot-forged for thickness reduction of 30%, which was produced according to a conventional method, and will be referred to as pure Mo-forged sample, and a target in which the substrate layer was of TZM, which will be referred to as TZM sample.

In those TiC-added sample, pure Mo-forged sample and TZM sample, the mechanical properties of the substrate were determined according to the three-point bending test and the tensile test, as mentioned in Example 1. These tests were carried out on the condition that the dimension in the parallel zone was 1×4×25 mm, that the cross head speed was 1 mm/min, and that the test temperatures were room temperature and 1000° C. From the maximum load in the load-displacement curve as obtained in the tensile test, calculation was carried out about the tensile strength of each sample.

Figure 5:
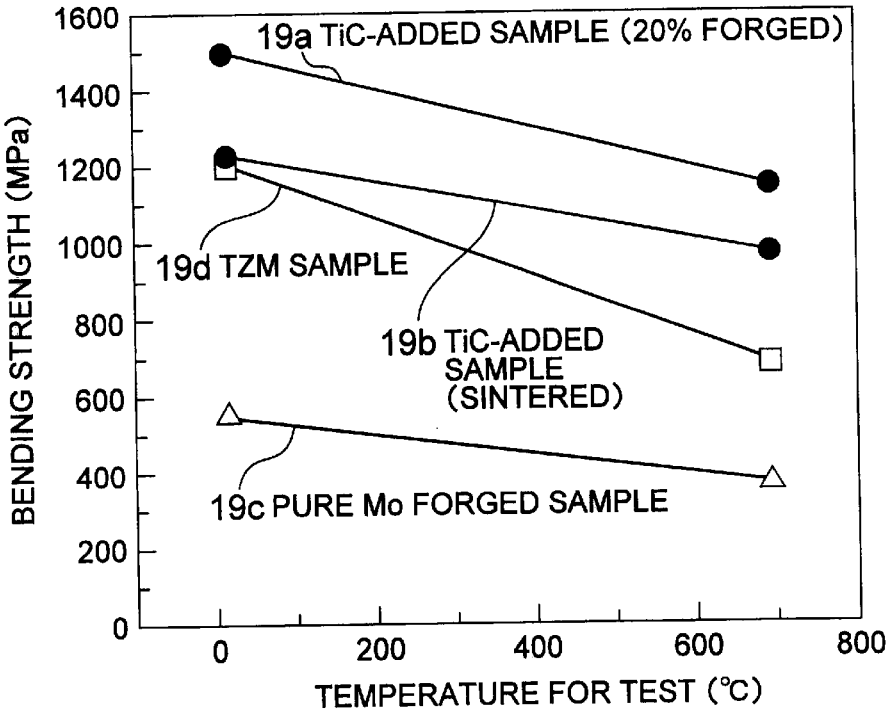
FIG. 5 is a graph showing the temperature dependence of the bending strength of 1.0 wt. % TiC-added samples of the invention and that of comparative, pure Mo and TZM samples, all prepared in the second embodiment of the invention.

FIG. 5 is referred to, in which it is known that the TiC-added sample, which is a sintered sample and gives the lines 19*a* and 19*b,* has the bending strength at room temperature about 2.2 times higher than that of the pure Mo-forged sample giving the line 19*c,* and equal to the TZM sample giving the line 19*d*), respectively.

The TiC-added sample, which is a sintered sample and gives the lines 19*a* and 19*b,* has the bending strength at 700° C. about 2.5 times and about 1.4 time higher than that of the pure Mo-forged sample (shown in line 19*c*) and the TZM sample (shown in line 19*d*), respectively.

Figure 6:
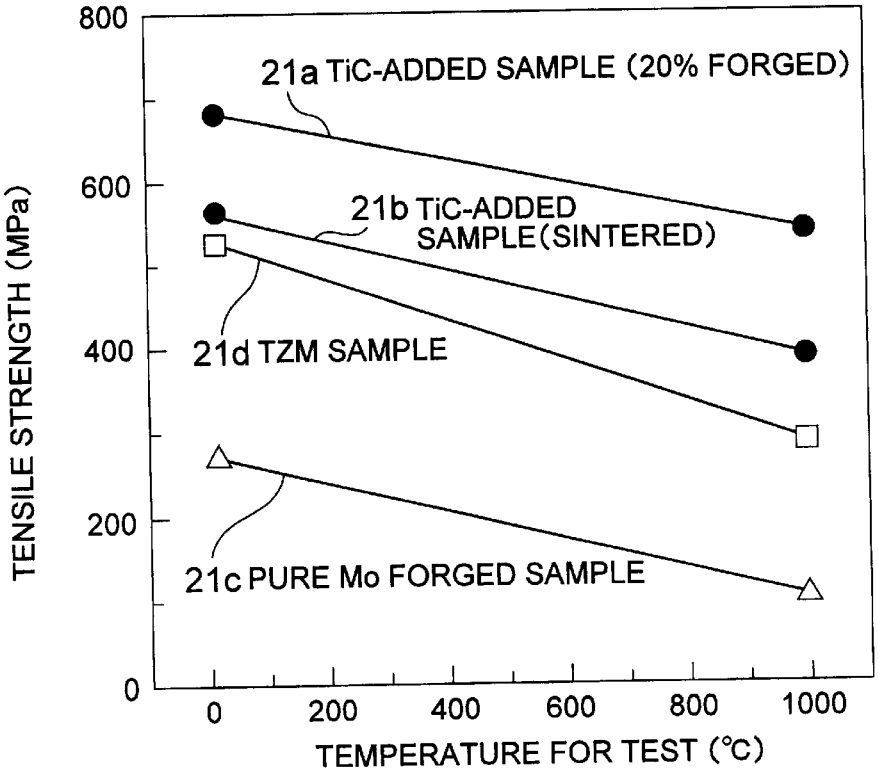
FIG. 6 is a graph showing the temperature dependence of the tensile strength of 1.0 wt. % TiC-added samples of the invention and that of comparative, pure Mo and TZM samples, all prepared in the second embodiment.

FIG. 6 is referred to, in which it is known that the TiC-added sample, which is a sintered sample and gives the lines 21*a* and 21*b,* has the tensile strength at room temperature of is about 2.1 times higher than that of the pure Mo-forged sample giving the line 21*c* and comparable to that the TZM sample giving the lines 21*d,* respectively. At 700° C., the TiC-added sample which is a sintered sample and gives the lines 21*a* and 21*b* has the tensile strength of about 4.0 times and about 1.3 time higher than that of the pure Mo-forged sample and the TZM sample giving the lines 21*c* and 21*d,* respectively.

Accordingly, it is possible to produce targets having high strength at room temperature and at high temperatures by the use of a Mo alloy added with 0.2 to 1.5%, by weight, of TiC, as the substrate for targets. Thus, the targets produced are applicable to rotation at higher speeds and higher temperatures than conventional ones.

Other targets of the invention are described below.

Another embodiment of the method of producing the rotary anode, which will be hereinafter referred to as a simple term of "target", for X-ray tubes of the invention is described.

First, compacted bodies were prepared which were made of W powder and Mo powder compacted under different pressures to each other.

Figure 7:
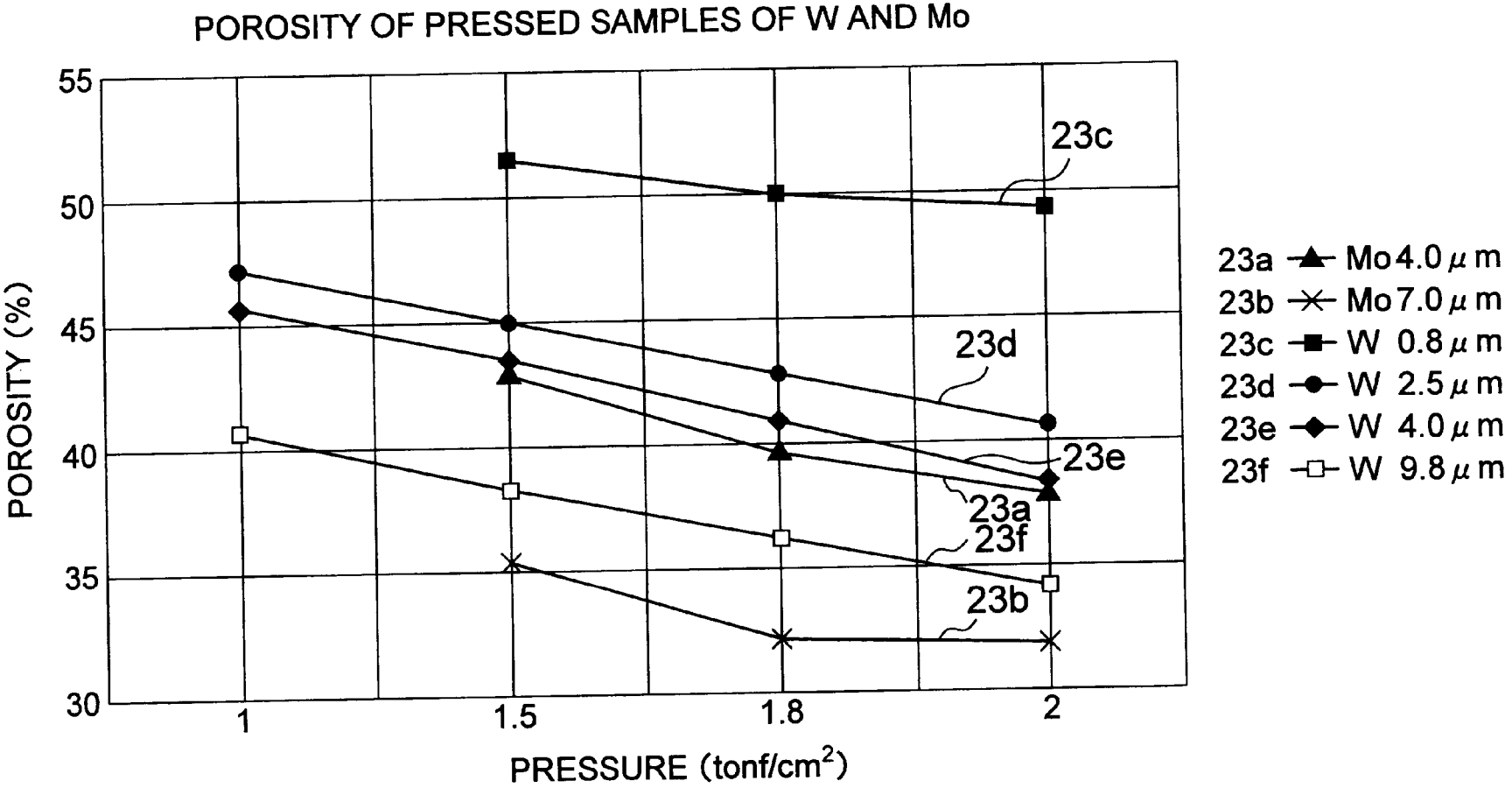
FIG. 7 is a graph showing the relationship between the pressure in the third embodiment of the invention for producing pressed samples and the porosity of the samples.

FIG. 7 is referred to, in which the curves 23*a* and 23*b* indicate the characteristics of Mo powder having a mean grain size of 4.0 μm and 7.0 μm, respectively. Furthermore, the curves 23*c* to 23*f* indicate the characteristics of W powder having a mean grain size of 0.8 μm, 2.5 μm, 4.0 μm and 9.8 μm, respectively. From these, it is known that the compacted bodies have a higher density so as to have a smaller degree of porosity. The W powder having a mean grain size of 0.8 μm, which is indicated by the curve 23*c,* gave compacted bodies having a large degree of porosity even when pressed under high pressure, and its compressibility into compacted bodies is poor. The Mo powder having a mean grain size of 7.0 μm and the W powder having a mean grain size of 9.8 μm, which are indicated by the curves 23*b* and 23*f,* respectively, have good compressibility to give compacted bodies having a small degree of porosity. When sintered, however, the density of the compacted bodies could hardly increase, and the sinterability thereof is poor. As opposed to those, the Mo powder having a mean grain size of 4.0 μm and the W powders having a mean grain size of 2.5 μm and 4.0 μm, which are indicated by the curves 23*a,* 23*d* and 23*e,* respectively, gave compacted bodies having a relatively small degree of porosity, and their compressibility is good. After having been sintered, the compacted bodies from those powders much increased in the density. From these data, it is desirable that W powder and Mo powder for use in the invention have a mean grain size falling between 1 μm and 5 μm.

Suitably selecting the grain size of the starting powders to be molded in the invention is necessary, in view of the relation between the grain size and the molding pressure and in order that the porosity of the compacted Re—W alloy layer could near that of the compacted, Mo-containing layer that comprises Mo or an Mo—TiC alloy. This is for increasing the dimension accuracy of the sintered product of the two layers.

Figure 8A:
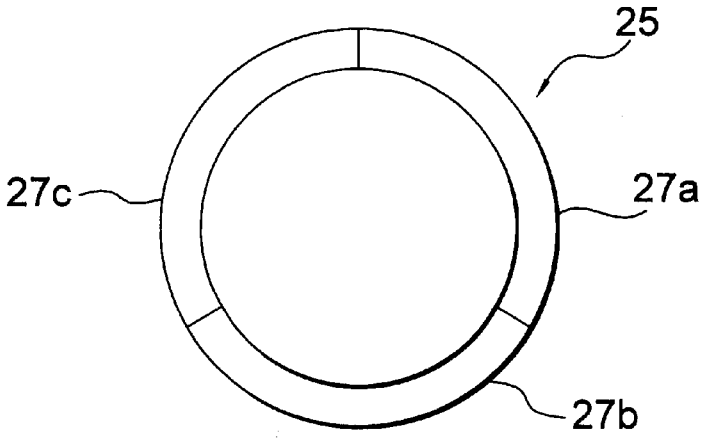
FIG. 8A and FIG. 8B are cross-sectional views of a device to be used in one step of the process for producing the rotary anode for X-ray tubes according to the third embodiment of the invention.
Figure 8B:
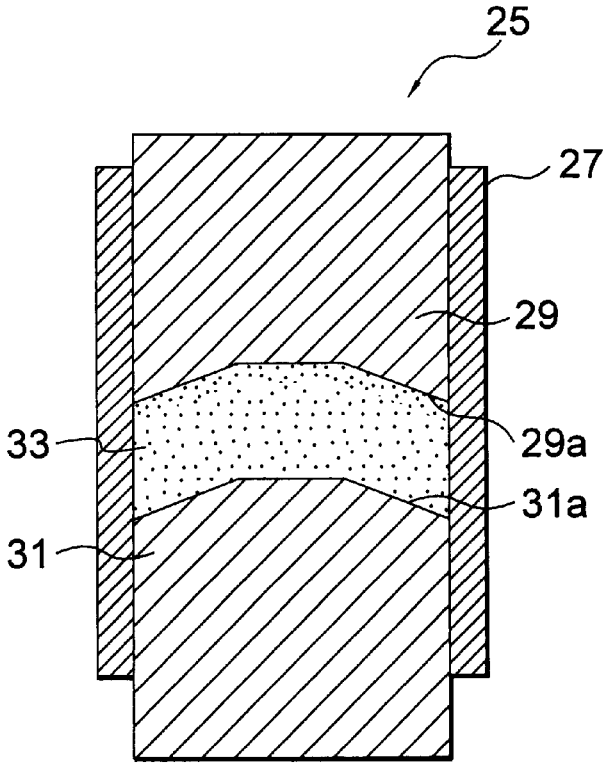

FIG. 8A and FIG. 8B are referred to, in which the mold 25 is composed of a mortar 27, an upper rod 29, and a lower rod 31. The mortar has three portions 27*a,* 27*b,* and 27*c,* divided from one another. The upper rod 29 and the lower rod 31 have opposed faces which are formed to have a so-called umbrella-shaped, truncated cone depression 29*a* and an umbrella-shaped, truncated cone projection 31*a,* respectively.

For producing the compacted body, use is made of the mold 25 having the three portions as shown in FIG. 8A and FIG. 8B. The lower rod 31 is set in the mold 25, and a predetermined amount of Mo powder is put into it. The powder is lightly molded under a pressure of 20 kg or so, and then a predetermined amount of Re—W powder having been blended in a V-type mixer is put over it. The powder 33 is compressed between the upper and lower rods 29 and 31 capable of giving the shape of an umbrella-like target.

Figure 9:
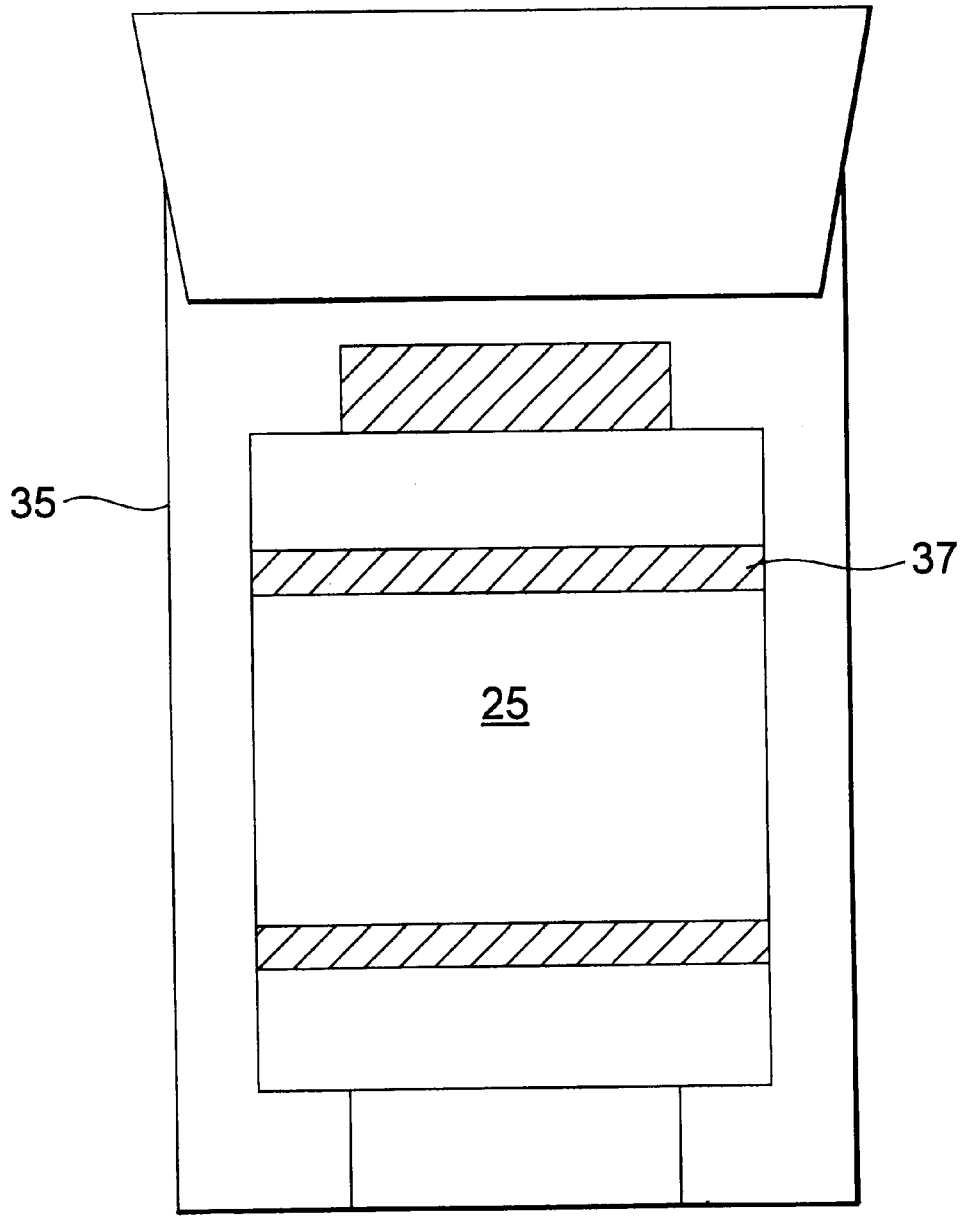
FIG. 9 is a cross-sectional view of a device to be used in another step of the process for producing the rotary anode for X-ray tubes according to the third embodiment of the invention.

FIG. 9 is referred to, in which the mold 25 having therein the powder noted above is set in a rubber bag 35, and the powder therein is subjected to CIP, i.e. cold isostatic pressing. For this, the pressure may fall between 147 MPa and 392 MPa. In FIG. 9, 37 is a belt for keeping the three-divided mortar 27 into one body.

In a conventional molding method, powder is put into an integrated mortar mold and is pressed from the upper and lower sides. In that, therefore, the molded body formed is often slipped, cracked or fissured due to the friction against the side surface of the mortar 27, if an organic binder is not added to the Re—W powder or the Mo powder.

According to the method of the invention, however, since the powder receives the omnidirectional pressure from the upper and lower rods 29 and 31 and from the three-divided mortar 27, the mold friction can be reduced. In the method, therefore, a compacted body is obtained which has no defect even when no organic binder is added to the powder.

Next, the compacted body is sintered in a hydrogen atmosphere at a first sintering temperature falling between 1800° C. and 2000° C., which will be referred to as a step of first sintering. When the first sintering temperature is lower than 1800° C., the density of the sintered body could not increase, and, then the sintered body will be deformed to lose dimension accuracy since the W—Re layer and the Mo-containing layer that comprises Mo or an Mo—TiC alloy have different degrees of contraction.

The sintered body is then further sintered in vacuum. For this, preferably, the vacuum degree falls between $10^{-6}$ Torr and $10^{-8}$ Torr, the temperature falls between 1800 and 2200° C., and the time are not shorter than 5 hours. When the vacuum degree is lower than $10^{-6}$ Torr, the vapor component could not be fully removed from the body. If so, the life of the X-ray tube that comprises a target of the sintered body will be short. In order to promote the sintering, the temperature for the second sintering is preferably higher than that for the first sintering as effected in a hydrogen atmosphere. However, when the second sintering temperature is higher than 2200° C., the furnace for the sintering will require an expensive heat-insulating structure, which is not economical. After having been thus sintered, the body is then worked to have a final shape.

Other targets of the invention are described more concretely with reference to the following Examples.

EXAMPLE 3

W powder having a mean grain size of 4.0 $\mu$m was added with 2% by weight of Re powder having a mean grain size of 2.0 $\mu$m, and dry-blended in a V-type mixer for 2 hours. As a Mo powder, use was made of one having a mean grain size of 4.0 $\mu$m.

As shown in FIG. 8A and FIG. 8B, 350 g o f the Mo powder was first put into the mold composed of the three-divided mortar 27 having an outer diameter of 75 mm and the umbrella-shaped lower rod 31, and equalized with an umbrella-shaped equalizing tool. Next, the powder was lightly compressed with the umbrella-shaped upper rod 29 under a pressure of about 30 kg. After the upper rod 29 was removed, 230 g of the W—Re powder having been blended in the V-type mixer was poured onto the Mo powder, and then equalized in the same manner as above. Next, the upper rod 29 was again set on the W—Re powder.

This was put into the cylindrical rubber bag or rubber mold 35 shown in FIG. 9, and molded through isostatic pressing under a pressure of 1.5 tons/cm$^2$. The compacted body was then sintered in hydrogen at 1700° C. for 10 hours, in a continuous hydrogen furnace. The dimension of the sintered body contracted by 20%. The degree of contraction of the W—Re alloy layer was the same as that of the Mo-containing layer. As a result, the sintered body was not deformed.

The sintered body was further sintered in vacuum at a vacuum degree of $10^{-6}$ Torr and at 2000° C. for 5 hours into a vacuum-sintered body. The resulting vacuum-sintered body was then lathed to have a final umbrella-like shape. Thus, a final product is obtained.

The final product was constructed into an X-ray rotary target, and evaluated. As a result, it was found that the vapor generation at high temperatures from the target produced herein was smaller than that from a conventional target. It was also found that the target produced herein had a greatly prolonged life and much increased reliability.

EXAMPLE 4

W powder having a mean grain size of 4.0 $\mu$m was added with 5% by weight of Re powder having a mean grain size of 2.1 $\mu$m, and dry-blended in a V-type mixer for 2 hours. On the other hand, Mo powder having a mean grain size of 4.0 $\mu$m was added with 1.0% by weight of TiC powder having a mean grain size of 1.0 $\mu$m, and dry-blended in a V-type mixer for 2 hours.

Into the same mold as described in Example 3, the mixed powders were filled in the similar manner being described in Example 3. The amounts of the powders were the same as those in Example 3.

The powders were through isostatic pressing also in the same manner as in Example 3, and the compacted body was then sintered in hydrogen at 1700° C. for 10 hours, in a continuous hydrogen furnace. In the sintered body, the degree of contraction of the W—Re alloy layer was the same as that of the Mo-containing layer, and the sintered body was not deformed.

The sintered body was further sintered in vacuum at a vacuum degree of $10^{-6}$ Torr and at 2000° C. for 5 hours into a vacuum-sintered body. The resulting vacuum-sintered body was then lathed to have a final umbrella-like shape. Thus was obtained a final product. The final product was constructed into an X-ray rotary target, and evaluated. As a result, it was found that the vapor generation at high temperatures from the target produced herein was smaller than that from a conventional target. It was also found that the target produced herein had a greatly prolonged life and much increased reliability.

EXAMPLE 5

The final products produced in Examples 3 and 4 were subjected to a revolution test, in which they were checked for cracks. In the test, the samples were revolved at 20000 rpm for 10 minutes in one cycle, and subjected to 6 cycles for revolution. As a result, the both products were not cracked in the test.

EXAMPLE 6

W powder having a mean grain size of 4.0 $\mu$m was added with 2% by weight of Re powder having a mean grain size of 2.0 $\mu$m, and dry-blended in a V-type mixer for 2 hours. As a Mo powder, use was made of one having a mean grain size of 4.0 $\mu$m.

350 g of the Mo powder was first put into a mold composed of a three-divided mortar having an outer diameter of 75 mm and an umbrella-shaped lower rod, and equalized with an umbrella-shaped equalizing tool. Next, the powder was lightly compressed with an umbrella-shaped upper rod under a pressure of about 30 kg. After the upper rod was removed, 230 g of the W—Re powder having been blended in the V-type mixer was poured onto the Mo powder, and then equalized in the similar manner being above-described. Next, the upper rod was again set on the W—Re powder.

This was put into a cylindrical rubber mold, and molded through isostatic pressing under a pressure of 1.5 ton/cm$^2$. The compacted body was then sintered in hydrogen at 1700° C. for 10 hours, in a continuous hydrogen furnace. The dimension of the sintered body contracted by 20%, and the degree of contraction of the W—Re alloy layer was the same as that of the Mo layer. As a result, the sintered body was not deformed. The sintered body was further sintered in vacuum at a vacuum degree of $10^{-6}$ Torr and at 2000° C. for 5 hours. The resultant vacuum-sintered body was then lathed to have a final umbrella-like shape. The thus-worked final product was constructed into an X-ray rotary target, and evaluated. As a result, it was found that the vapor generation at high temperatures from the target produced herein was smaller than that from a conventional target. It was also found that the target produced herein had a greatly prolonged life and much increased reliability.

In the Examples of the invention mentioned hereinabove, the Mo-containing layer is of Mo or an Mo—TiC alloy only. However, in place of adding TiC powder thereto, any of HfC powder and ZrC powder can be added to Mo, either singly or as combined with TiC powder in the form of a mixture of two or more of those powders, to obtain the same results as above.

As has been mentioned hereinabove, in the invention, an Mo alloy containing from 0.2% by weight to 1.5% by weight of at least one of TiC, HfC and ZrC is used for forming the substrate layer of the rotary anode for X-ray tubes. Therefore, the rotary anode for X-ray tubes of the invention has high strength at room temperature and at high temperatures, in which the grains hardly grow into coarse and large grains even when heated at high temperatures and of which the strength is lowered little even at high temperatures.

In addition, in the invention, 0.2 to 1.5% by weight of at least one of TiC, HfC and ZrC is added to Mo for forming the substrate layer. Therefore, the invention has realized the production of rotary anodes for X-ray tubes, for which the sintered bodies and even those having been subjected plastic working for small thickness reduction could have increased intergranular strength and therefore have increased mechanical strength at room temperature and at high temperatures. Specifically, in the invention, high-strength rotary anodes for X-ray tubes can be formed from sintered bodies and from those having been subjected to plastic working for small thickness reduction, and therefore the yield of the products is much increased. Thus, the invention has realized the production of low-priced products.

In addition, according to the invention, the strength at room temperature and at high temperatures of the substrate for rotary anodes for X-ray tubes is increased. Therefore, the rotary targets of the invention are applicable to high-speed rotation, and the invention provides the method for producing the rotary anodes.

Further, in the invention, the grain size of the W powder, the W—Re powder and the Mo powder to be used is optimized, the powder mixture is isostatically molded, and the contraction of the sintered body is unified. Therefore, in the invention, since the shape of the sintered body formed may be nearly the same as that of the final product, the weight of the raw material to be used may be 1.2 to 1.5 times that of the product. In addition, since the starting powder can be compacted through isostatic powder molding, without using any organic binder, the carbon residue to be in the final product can be reduced. Accordingly, the invention provides high-quality and long-life rotary anodes for X-ray tubes, and a method for producing them.

While the invention has been described in detail and with reference to specific embodiments thereof, it will be apparent to one skilled in the art that various changes and modifications can be made therein without departing from the spirit and scope thereof.

What is claimed is:

1. A rotary anode for X-ray tubes having a two layered structure composed of an Mo-containing layer and a W—Re alloy layer laminated to said Mo-containing layer, said Mo-containing layer comprising, by weight, 0.2 to 1.5% of at least one of TiC, Hfc, and ZrC, and the balance being substantially of Mo or an Mo alloy and having a higher mechanical strength at high temperatures than Mo and Mo alloy containing Ti, Zr, and C added to Mo as simple substances.

2. The rotary anode for X-ray tubes as claimed in claim 1, wherein said Mo-containing layer is a substrate, said W—Re alloy layer being an X-ray generating layer that overlies said substrate.

3. The rotary anode for X-ray tubes as claimed in claim 2, wherein said substrate has the bending strength of 800 MPa or more at 700° C.

4. The rotary anode for X-ray tubes as claimed in claim 2, wherein said substrate has the tensile strength of 300 MPa or more at 1000° C.

* * * * *